US011492848B2

(12) United States Patent
Kazanjian

(10) Patent No.: US 11,492,848 B2
(45) Date of Patent: Nov. 8, 2022

(54) LADDER STABILIZER AND LEVELER

(71) Applicant: David Kazanjian, Croydon, PA (US)

(72) Inventor: David Kazanjian, Croydon, PA (US)

( * ) Notice: Subject to any disclaimer, the term of this patent is extended or adjusted under 35 U.S.C. 154(b) by 0 days.

(21) Appl. No.: 16/003,925

(22) Filed: Jun. 8, 2018

(65) Prior Publication Data

US 2019/0055784 A1 Feb. 21, 2019

Related U.S. Application Data

(60) Provisional application No. 62/547,795, filed on Aug. 19, 2017.

(51) Int. Cl.
*E06C 7/42* (2006.01)
*E06C 1/06* (2006.01)
*E06C 7/44* (2006.01)

(52) U.S. Cl.
CPC ..... *E06C 7/423* (2013.01); *E06C 1/06* (2013.01); *E06C 7/44* (2013.01)

(58) Field of Classification Search
CPC ... E06C 4/23; E06C 1/06; E06C 7/423; E06C 7/44; E06C 1/16; E06C 1/20; E06C 1/14
USPC ..... 182/201, 204, 205
See application file for complete search history.

(56) References Cited

U.S. PATENT DOCUMENTS 1,376,777 A * 5/1921 O'Connor ..... E06C 7/44 182/205
2,147,052 A * 2/1939 Noone ..... E06C 7/44 182/205
2,405,269 A * 8/1946 Prutsman ..... E06C 7/44 182/205
2,936,849 A * 5/1960 Larson ..... E06C 7/44 182/204
3,554,321 A * 1/1971 Stedman ..... E06C 7/44 182/201
4,069,893 A * 1/1978 Blackstone ..... E06C 7/44 182/200
4,807,720 A * 2/1989 Kim ..... E06C 7/44 182/205
5,064,024 A * 11/1991 Barham ..... E06C 7/44 182/201
5,082,088 A * 1/1992 Krause ..... E06C 1/32 182/204

(Continued)

*Primary Examiner* — Daniel P Cahn
*Assistant Examiner* — Shiref M Mekhaeil
(74) *Attorney, Agent, or Firm* — Ryder, Mazzeo & Konieczny LLC; Joseph M Konieczny, Sr.

(57) ABSTRACT

A ladder stabilizer comprises a pair of stabilizer brackets attached to the ladder side rails at the bottom on either side. Each bracket has a C-shaped clamping mechanism that utilizes a toothed gear rack which engages/disengages with mating teeth of a corresponding gear rack on the ladder rail. The gear-like engagement of the teeth provides a positive locking of the attachment member to the ladder. A spring and locking screw allow ease of adjustment and a positive lock at the desired location along the ladder side rail. The rack is attached longitudinally along the length of each rail to provide a range of length adjustment to the feet. This permits one side to be longer than the other to accommodate a laterally sloping terrain. The brackets have rotatable, laterally extending A-frames with ground-engaging feet which self-adjust to a terrain which is sloping from front-to-back or vice versa.

16 Claims, 4 Drawing Sheets

(56) References Cited

U.S. PATENT DOCUMENTS

| | | | | | |
|---|---|---|---|---|---|
| 5,273,133 | A * | 12/1993 | Thocher | E06C 7/44 | 182/202 |
| 5,476,153 | A * | 12/1995 | Dickerson | E06C 7/44 | 182/108 |
| 5,542,497 | A * | 8/1996 | Macyszyn | E06C 7/44 | 182/201 |
| 5,918,698 | A * | 7/1999 | Lunn | E06C 7/423 | 182/107 |
| 6,053,284 | A * | 4/2000 | Fountain | E06C 7/423 | 182/180.2 |
| 6,435,306 | B2 * | 8/2002 | Stoneburg | E06C 7/44 | 248/188.5 |
| D479,339 | S * | 9/2003 | McDonald | D25/68 | |
| 7,017,711 | B1 * | 3/2006 | Ali | E06C 1/39 | 182/201 |
| 9,556,675 | B2 * | 1/2017 | Reyes | F16M 11/38 | |
| 10,214,961 | B2 * | 2/2019 | Moss | E06C 7/003 | |
| 2011/0011674 | A1 * | 1/2011 | Kim | E06C 1/22 | 182/106 |

* cited by examiner

LADDER STABILIZER AND LEVELER

RELATED APPLICATIONS

This is a non-provisional patent application related to provisional application No. 62/547,795 filed Aug. 19, 2017 entitled, "Ladder Stabilizer and Leveler" priority from which is hereby claimed.

FIELD OF THE INVENTION

The present invention relates in general to a device which stabilizes a ladder to prevent it from tipping or slipping while in use. Furthermore it relates to those ladder stabilizers which also permit the base of the ladder to adjust to a sloping terrain to provide a level footing.

BACKGROUND OF THE INVENTION

Due to the many accidents that are result of using ladders there have been many attempts to provide a ladder with at stabilizing feature at the base of the ladder. Professional painters, carpenters and utility workers who use ladders in their work daily are most often the victims of ladder accidents. Too, the average home owner has ladder falls due to their inexperience with proper ladder use.

Among the previous attempts to devise a safer ladder are those described in the following US patents: U.S. Pat. No. 2,371,460 issued to Needham; U.S. Pat. No. 4,792,017 issued to Grove; U.S. Pat. No. 4,069,893 issued to Blackstone; U.S. Pat. No. 3,025,926 issued to Vives; U.S. Pat. No. 5,423,397 issued to Boughner; and U.S. Pat. No. 5,551,529 issued to Molitor. Despite these many attempts to devise a more stable and safer ladder, no adequate solution has been found. The past devices are often difficult to operate and lack the strength to adequately support the weight of the ladder and the user if the ladder should tip to the side.

SUMMARY OF THE INVENTION

In order to solve the problem of ladder safety which the art has not adequately addressed, the applicant has devised a superior safety ladder, or an accessory for an existing ladder, which overcomes the deficiencies in the field. As described in more detail below with regard to the drawings and description of the preferred embodiments, the new and improved ladder stabilizer provides a broad range of adjustability to accommodate many different footings in which ladders are often used. The present device can easily adjust to any sloping or uneven terrain while also providing a level and structurally strong lateral footing in all directions.

As described in more detail below, the applicant has devised supplemental feet affixed to the ladder rails by identical brackets, one on each side which function independent of one another. The brackets each have a laterally extendable outrigger arm which carries a pair of rotatable A-frames at its end. The two A-frames provide a four-point stance for the ladder.

A key feature of the invention is how it provides a structurally strong yet adjustable attachment of the supplemental feet to the ladder rails. Each bracket has a C-shaped clamping mechanism that utilizes a toothed rack that engages/disengages with mating teeth of a corresponding gear rack on the ladder rail. The gear-like engagement of the teeth provides a positive locking of the attachment member to the ladder. A spring and locking screw allow ease of adjustment and a positive lock at the desired location along the ladder side rail. The rack is attached longitudinally along the length of each rail to provide a range of length adjustment to the feet. This permits one side to be longer than the other to accommodate a laterally sloping terrain. Also, the rotatable A-frames self-adjust to a terrain which is sloping from front-to-back or vice versa. The outriggers are telescoping so that a broad stance can be provided by a compactable assembly that can be adjusted through a range of extension.

More specifically, the applicant has invented a ground-engaging stabilizer system for a ladder including a ladder comprising two side rails, a right and a left side rail, and a plurality of laterally extending interconnecting rungs between them, each side rail have a front, a backside and inward and outward facing sides. A first clamping bracket can be affixed to the left side rail of the ladder, said bracket having two opposed longitudinally extending runners, a first front runner and a second rear runner, and an outward facing mounting plate joining them. A first bracket at the left side has a first longitudinally extending mechanical engagement feature with a plurality of laterally projecting elements affixed to the second runner and adapted for engagement with second compatible engagement elements on a second engagement feature on the backside of the ladder left side rail. The bracket has a clamping screw threadably affixed to the first runner and adapted for engagement with the front of the ladder left side rail whereby rotation of the screw forces the first runner away from the front of the side rail thus forcing the second runner toward the backside of the rail to hold the first and second mechanical engagement features engaged. A compression spring is located between the front runner and the front of the ladder rail to bias the mechanical engagement features on the rear runner of the bracket toward engagement. A second clamping bracket being a mirror image of the first bracket is affixed to the right side rail of the ladder, said right side rail having third engagement features on the backside of the rail compatible with fourth engagement features on the rear runner of the second bracket. The mechanical engagement features on each of the brackets and each of the side rails can be matching gear racks each having a plurality of teeth extending side-by-side along the length of each of the mechanical engagement features.

To provide easy attachment and removal of the brackets the effective front-to-back clamping width between the front runner and the engagement features on the rear runner of each bracket is greater along a portion of the ladder side rail in an adjustment region adjacent the engagement features on each rail. The effective clamping width of other portions of the ladder side rail is narrower. The bracket is constructed such that the bracket is laterally captivated to the side rail only in the adjustment region by front and a rear captivation plates each affixed to one of the front and the rear runners respectively. The captivation plates operate against the inward facing side of the ladder side rail to laterally captivate the bracket to the ladder in the adjustment region. The bracket has a lateral opening between the captivation plates sufficient to allow narrower portions of the ladder rail not in the adjustment region to pass through. Easy removal of the brackets can be achieved by disengaging the clamp and sliding it upward to an area along the side rail above the adjustment region and then pulling it off to the side.

It should be understood that the embodiments described below in the drawings and description of the invention are exemplary and that a person skilled in the art may make many variations and modifications without departing from the spirit and scope of the invention. Accordingly, all such variations and modifications are intended to be included within the scope of the embodiments described herein.

DETAILED DESCRIPTION OF PREFERRED EMBODIMENTS

Figure 1:
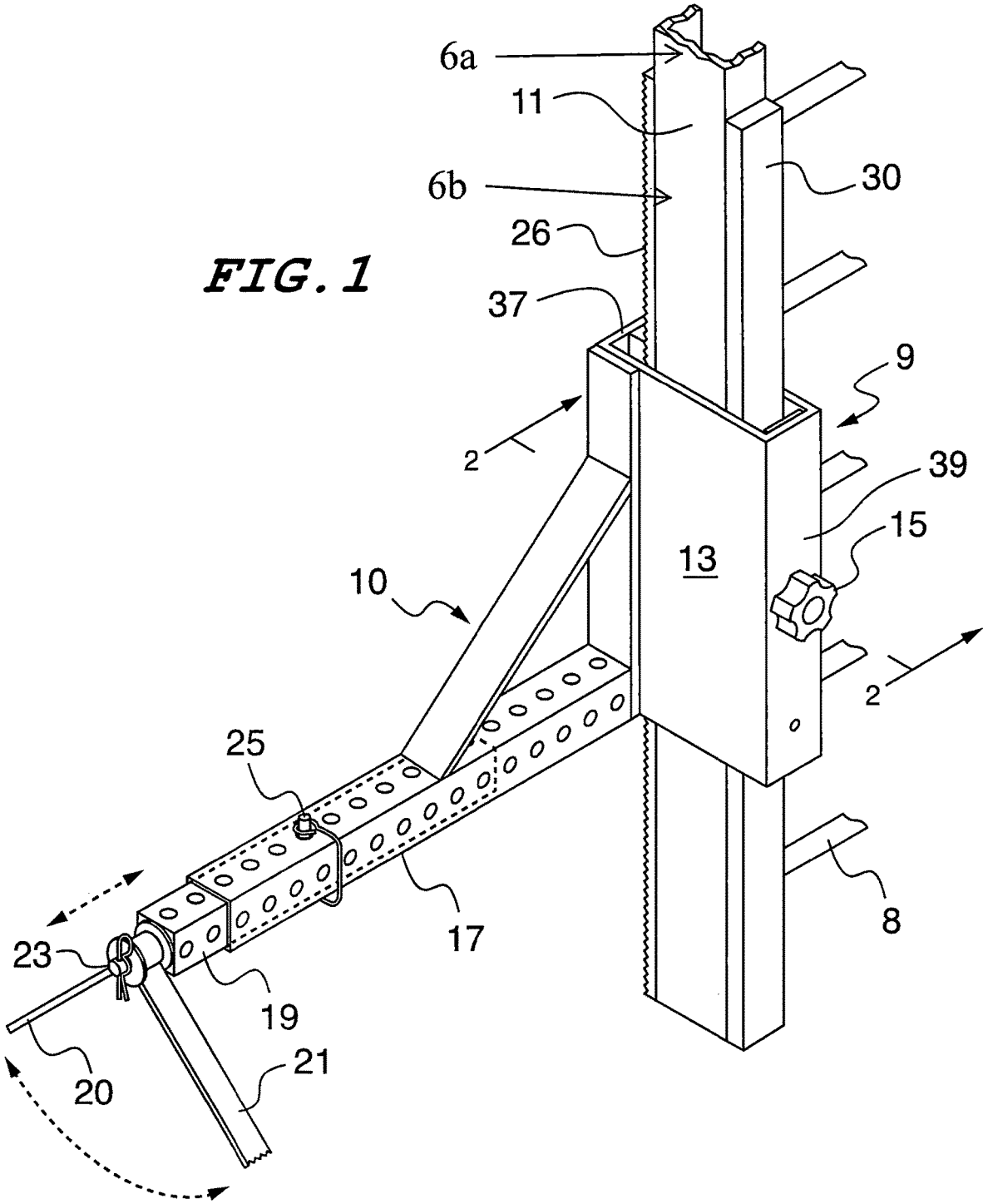
FIG. 1 is a top left front isometric view showing the invention clamped to a ladder side rail.

One embodiment of the ladder stabilizer of the invention comprises two main parts clamped to opposite ladder side rails adjacent a bottom portion 6*b* of a ladder by a unique clamping mechanism. Only the left side is shown in the drawings since a second right side is a mirror image of the left side and functions in the same way. Thus it is unnecessary for a complete understanding of the invention for both parts of the invention to be separately described, it being understood that the same structures shown here will also apply to the right side part functioning in the same way as its corresponding elements at the left. It will also be readily understood that since each side part of the pair can operate separately, the effective length of each side rail can be changed independently so that many different terrain variations can be accommodated.

Referring now to FIG. 1, this embodiment of the invention is adapted for use with a common form of a ladder that has an upper portion 6*a*, a bottom portion 6*b*, two parallel elongate side rails 11 interconnected by a series of rungs 8 between them. The right side rail is not shown here for the same reason explained above, namely that the ladder is symmetrical so that the right side rail an accompanying bracket is a mirror image of the left shown here. The left side of the stabilizer comprises clamping bracket 9 clamped to ladder side rail 11. The bracket 9 has an outward facing mounting plate 13 joining front and rear runners 39 and 37 which operate against a front and a backside of the rail, respectively. A telescoping lateral arm assembly 10 having inter-fitting members 17 and 19 is rigidly affixed to mounting plate 13. The inner telescoping member 19 carries a freely rotatable A-frame at the end having legs 20 and 21. The A-frame is releaseably secured to an axle 23 of the arm assembly by a cotter pin. The inner telescoping member 19 is held in position by a second pin 25 and may assume various degrees of locked extension away from the ladder side rail by passing the pin 25 through sets of aligned holes through the internal and external members when the desired amount of extension is selected. It will also be appreciated that constructed in this way the assembly can be easily disassembled for transportation.

The two legs of the A-frame, 20 and 21, have ground-engaging feet upon which the stabilizer stands. With the addition of the two other legs on a similar bracket on the other side of the ladder, a four-point stance of the stabilizer is created. Preferably the front leg 21 of the A-frame is longer that the other to accommodate the natural backward lean of the ladder. As will be further explained with regard to the following description, the clamp may be vertically positioned and locked to the ladder side rail by use of a toothed gear rack 26 affixed to the rear of the rail in the bottom portion 6*b* of the ladder. The bracket is held in the locked position by a locking screw 15. With this construction the bracket 9 is slideably affixed to the side rail 11 in the bottom portion 6*b* so that the bottom ends of the ladder rails can be held above the supporting terrain. In that condition, the ladder can stand on the A-frame feet on each side providing a four-point stance. The ends of the legs may have shoes with features which provide enhanced grip.

Figure 2:
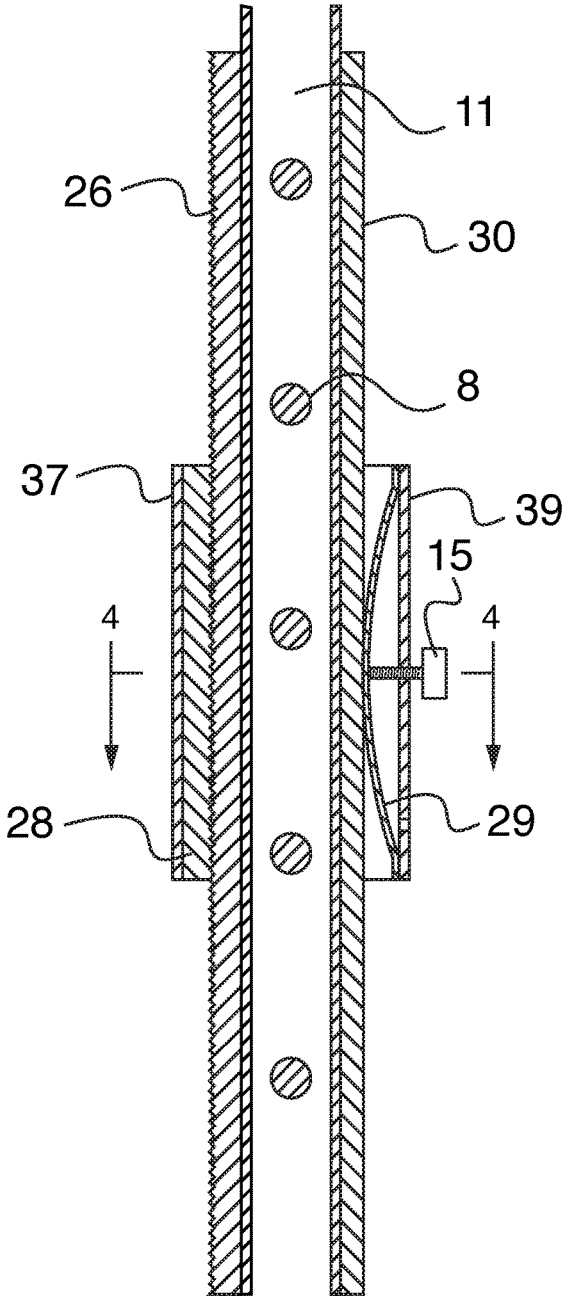
FIGS. 2 and 3 are left side elevation sectional views showing the invention in locked and unlocked states, respectively.
Figure 3:
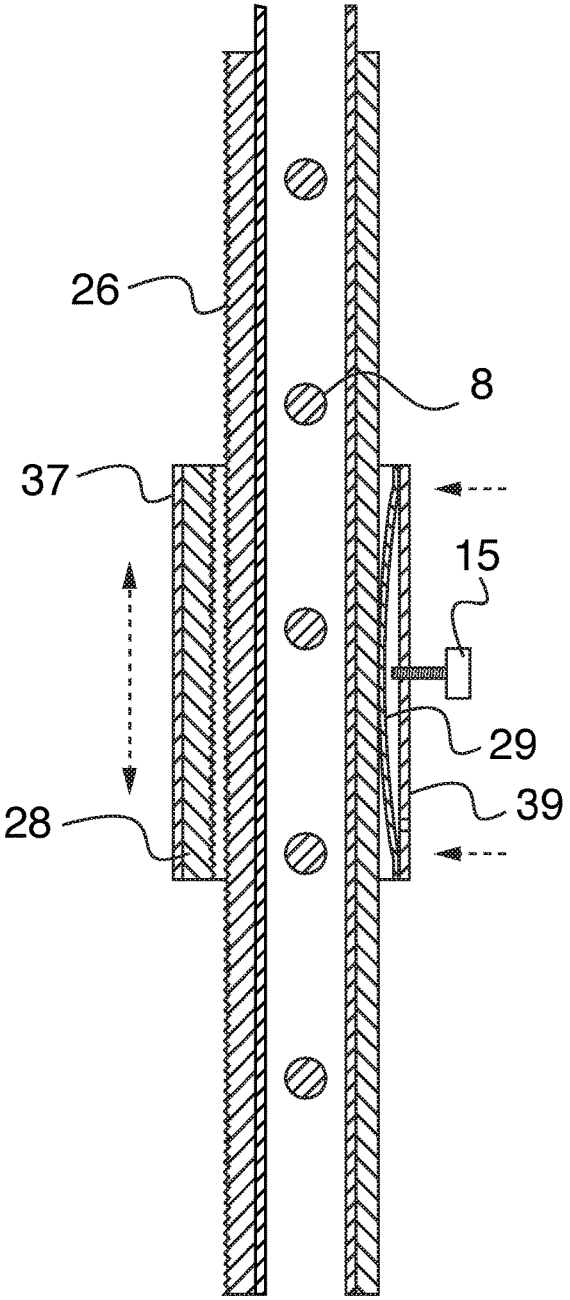

In FIGS. 2 and 3 the stabilizer clamping mechanism is shown in its locked and unlocked states, respectively. In its unlocked position it can be freely slide along the length of the ladder rail. Again, these same structures are coupled to the right side ladder rail, hence the ground-engaging A-frame feet can independently assume different vertical positions on the ladder rails to provide the ladder with a stable footing on an uneven or sloping terrain.

Referring now to FIG. 2, we see the left side of the stabilizer bracket pair which shows the interlocking of two mechanical engagement features, gear racks 26 and 28, each with teeth that mesh. Sensitive adjustment is possible because adjacent relative positions are only the distance of one tooth width apart. One gear rack 26 is affixed to the backside of side rail 11 and a second meshing gear rack 28 is affixed to the rear runner 37 of the bracket. The meshed gear teeth are secured together from being pulled apart by a locking screw 15 threaded through the front runner 39. Turning the screw 15 presses its end against spacer 30 and the front of the ladder rail pulling the gear rack on the rear runner 37 toward the backside of the rail forcing the teeth of gear racks 28 and 26 together. Safety leaf spring 29 is operative between the bracket front runner 39 and the front of the rail to bias the racks toward their engaged position when the screw 15 is loosened.

Figure 4:
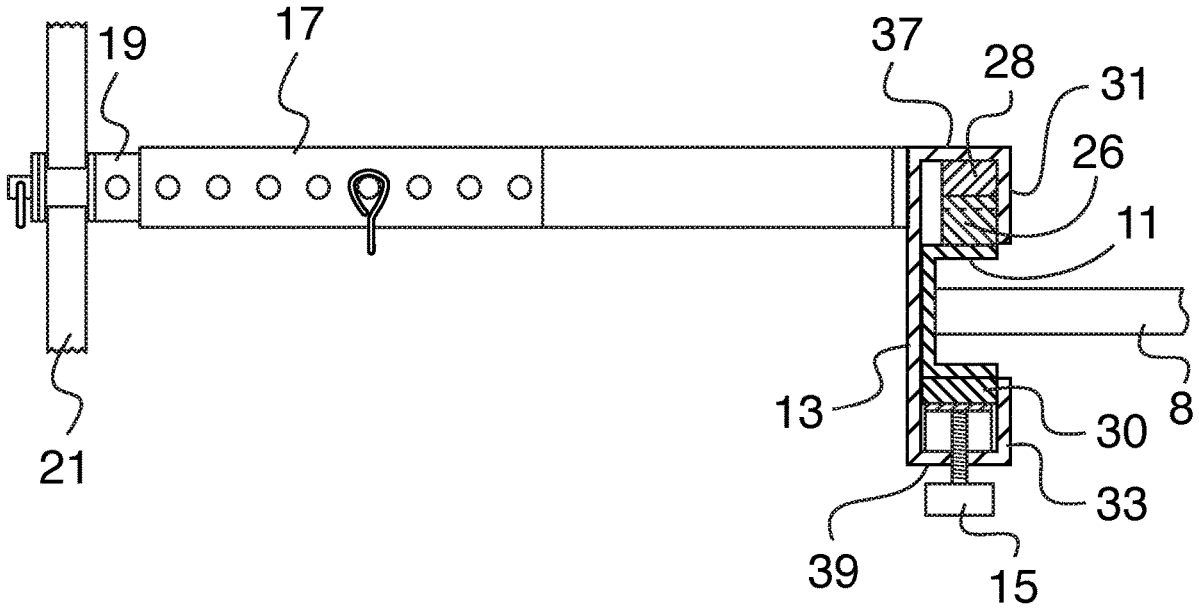
FIG. 4 is a top plan view taken from FIG. 2 as shown in that Figure showing the invention clamped to the ladder in the locked position.

The screw 15 and the spring 29 bears against spacer strip 30 which is affixed to the front of the side rail opposite the gear rack. This added structure 30 increases the width of the ladder rail in this region to ensure that the clamp stays captivated to the ladder rail throughout the length of the adjustment stroke as explained in more detail below. As seen in FIG. 2 the effective clamping width of the ladder rail including the spacer 30 and gear rack 26 is greatest in the adjustment region in the bottom portion 6*b* of the ladder. Above that region in the upper portion 6*a* of the ladder, the effective clamping width is the unencumbered width of the ladder rail which is significantly less. As seen in FIG. 4 below this permits the removal of the bracket from the ladder rail through the inward facing open jaw of the bracket. Also, while gear racks are employed in this embodiment other forms of mechanical engagement features can be employed which are lighter weight and less expensive but which provide a more coarse adjustment.

In FIG. 3 we see that the screw 15 is unscrewed and by pressing against the bracket the spring 29 is depressed moving the bracket rearward thereby disengaging the gear racks 26 and 28. In this position the clamp has become unlocked and ready to assume a different vertical position by sliding it up or down to a new position on the rail. These motions are indicated by the arrows in this figure. When the desired new position is reached the laterally applied force will be relaxed and the screw tightened to complete the process.

These same steps can be repeated to remove the clamp from the ladder. The gear rack 26 and the spacer 30 are located only along a small portion of the ladder side rails adjacent their bottom ends where the stabilizer is to be located and adjustment desired. The rack 26 and spacer 30 increase the width of the side rail in the area of the adjustment stroke so that the clamp is captivated to the side rail only in this region. When the clamp is disengaged and lifted to a point along the side rail above the rack 26 and spacer 30, the clamp can be removed from the rail laterally from the side of the rail 11 by rotating it slightly as it is pulled off to the side. Thus the stabilizer brackets can be attached or removed without having to move the ladder.

Referring now to FIG. 4, we see the clamp bracket mounting plate 13 with extension arms 17 and 19 that carry the A-frame 21. The clamp bracket is C-shaped in cross-section and has captivation plates 31 and 33 that wrap around the sides of the rack 26 and spacer 30. With this configuration, the clamp has a lateral opening that faces inwardly. In this position of locked engagement between gear racks 26 and 28 the clamp cannot be pulled away from the ladder side rail because the effective clamping width of the assembly is wider than the clamp opening. If the clamp is lifted above the rack 26 and spacer 30 where the rail alone is narrower because it has not been enlarged by those added structures, then the clamp can be removed because after rotating the bracket slightly the rail can then pass through the lateral clamp opening. This process is reversed to put the stabilizer onto the side rail.

Figure 5:
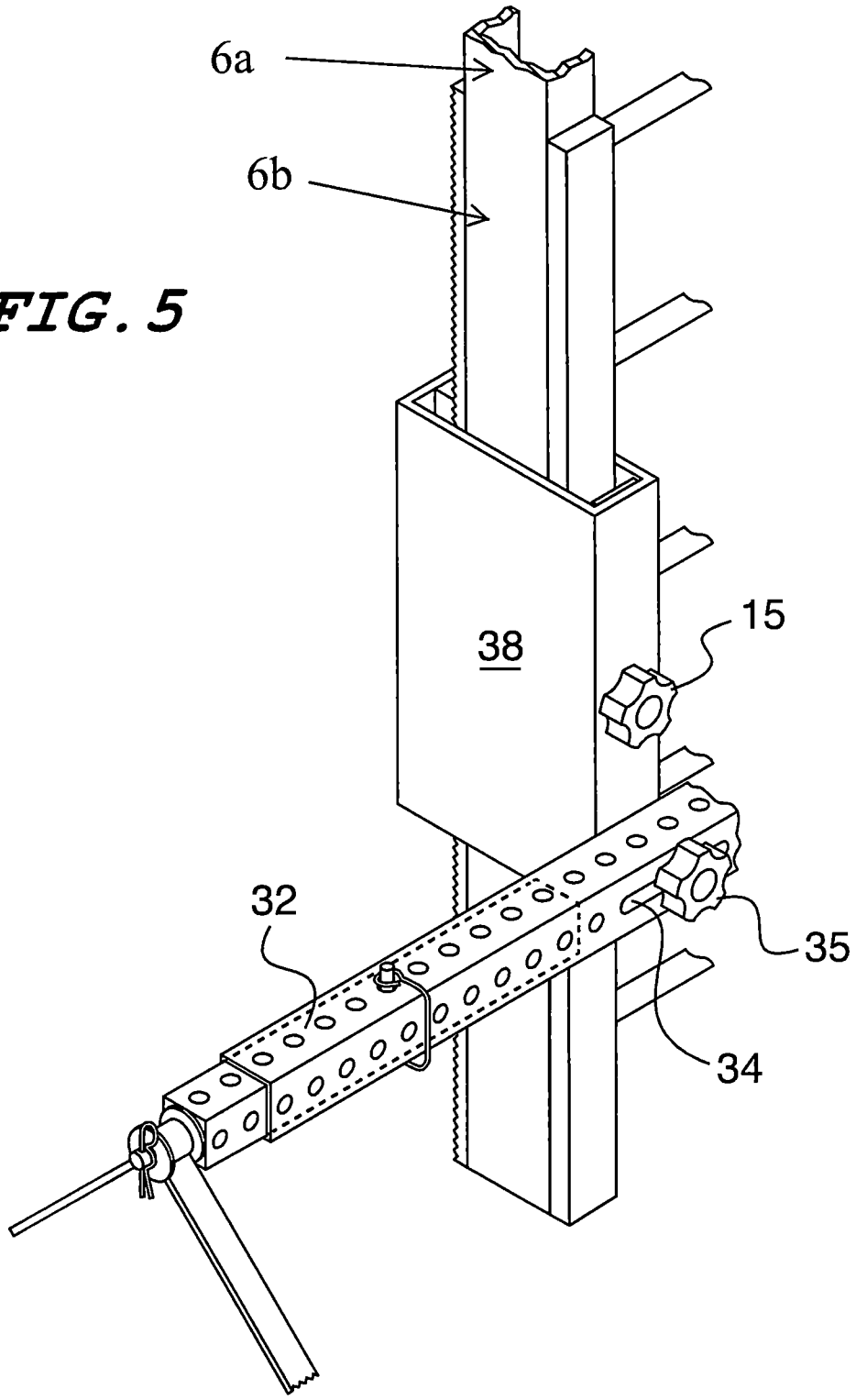
FIG. 5 is a top left front isometric view of an alternate embodiment of the invention.

FIG. 5 illustrates an alternate embodiment of the invention which has been simplified so that it can be manufactured less expensively. All parts of the bracket clamping mechanism 38 are the same as in the previous embodiment shown in FIGS. 1-4 except that the separate lateral arms are replaced by a single crossbar 32 that spans across and beyond both sides of the ladder. Only the left side is shown here, but again the right side components are mirror images of those at the left. The crossbar 32 is connected to each clamp bracket depicted here by clamp bracket 38 on the left side of the ladder by an attachment screw 35, one on each clamp bracket. The crossbar 32 carries the same telescoping members and A-frames on opposite ends as in the previous embodiment. Independent vertical movement of the individual rail clamps is allowed by slots such as slot 34 shown here in the crossbar through which the clamp attachment screw 35 passes. The attachment slots accommodate the concomitant length change when the individual clamps are moved to different levels on their respective rails.

The embodiments of the invention described above can be constructed from a wide variety of materials including steel, plastic, aluminum or any other suitable material having the most desirable weight and strength characteristics. Different components may be made of different materials. For example the gear racks may be made of aluminum or steel while the rest of the components may be constructed from plastic.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to falling within the claims which alone shall determine the scope of the invention.

The invention claimed is:

1. An apparatus for laterally leveling and stabilizing a ladder having a top, a bottom, a front, a back, a first and second opposed, longitudinally-extending side rails with a top end, a bottom end, a top portion and a bottom portion, a front face, an outer side face, an inner side face, a back face, and a front-to-back effective clamping depth, a plurality of laterally-extending rungs supported by said rails, and a first mechanical engagement feature on one of said front and back faces and extending along said bottom portion, comprising:

a clamp bracket adapted for affixation to one of said side rails of the ladder, said bracket having front and back opposed longitudinally-extending runners joined together along a first longitudinally-extending edge of each runner by an outer side plate, each of said runners having orthogonally-oriented inner plates fixed to a second longitudinally-extending edge of each runner and defining a lateral clamp opening; said runners, said outer side plate and said inner side plates being constructed and arranged to align with and overlap the front face, the back face, the outer side face and the inner side face of said one side rail; said runners, said outer side plate and said inner side plates defining a longitudinally-extending channel;

a second longitudinally-extending mechanical engagement feature affixed to one of said runners and adapted for engagement with said first mechanical engagement feature; and a clamping screw threadably affixed to one of said runners and adapted for operation against said one side rail whereby rotation of the screw forces said first and second mechanical engagement features to engage one another;

a laterally-extending arm affixed at a proximal end of said arm to said outer side plate; and a longitudinally-extending, ground-engaging leg at a distal end of said arm; wherein said bracket is configured to be variably positioned and locked along said first mechanical engagement feature so that said leg extends longitudinally at variable distances from the bottom of said ladder so that said leg levels and supports the ladder above the ground without the bottom of said ladder contacting the ground, and said leg contacts the ground at a position wider than a width of the ladder to deter lateral tipping; and, wherein said apparatus is configured to connect to the ladder in an upward, in-use position of the ladder by laterally receiving the upper portion of said one side rail through said lateral clamp opening and then sliding said apparatus downward over the bottom portion of said one side rail.

2. The apparatus recited in claim 1 further including a compression spring configured to be located between one of said runners and said one side rail to bias the other of said runners toward said one side rail.

3. The apparatus recited in claim 1 wherein the arm comprises two telescoping arm members whereby said leg may be selectively positioned at different lateral distances from said one side rail.

4. The apparatus recited in claim 1 wherein the first and second mechanical engagement features are matching gear racks each having a plurality of teeth extending side-by-side along a length of each mechanical engagement feature.

5. The apparatus recited in claim 1 wherein said leg has two angled ground-engaging feet joined at an apex which is rotatably affixed to said arm.

6. The apparatus recited in claim 1 in combination with said ladder to which it is affixed.

7. The apparatus recited in claim 6, wherein a width of said lateral clamp opening is smaller than the front-to-back effective clamping depth but larger than the width of the front and back faces of the side rail.

8. The apparatus recited in claim 1, wherein said one side rail has an enlarged, front-to-back effective width in the bottom adjacent the first engagement features, which prevents the clamp bracket from being installed on or removed from said one side rail in the bottom portion.

9. An apparatus for laterally leveling and stabilizing a ladder having a top, a bottom, a front, a back, a first and second opposed, longitudinally-extending side rails with a front face, an outer side face, an inner side face, a back face, a top end, a bottom end, a top portion and a bottom portion, and a front-to-back effective clamping depth, a plurality of laterally-extending rungs supported by said side rails, and a first mechanical engagement feature on one of said front and back faces and extending along said bottom portion, comprising:

right and left clamp brackets, each adapted for affixation to one of the side rails of the ladder, each of said brackets having front and back longitudinally-extending runners joined together along a first longitudinally-extending edge of each runner by an outer side plate, said runners having orthogonally-oriented inner side plates fixed to a second longitudinally-extending edge of each runner and defining a longitudinally-extending open jaw; said runners, said outer side plate and said inner side plates being constructed and arranged to align with and overlap the front face, the back face, the outer side face and the inner side face, of one of said side rails;

a second longitudinally-extending mechanical engagement feature affixed to one of said runners and adapted for engagement with said first mechanical engagement feature; and a crossbar affixed to said right and left clamp brackets respectively, said crossbar having opposite ends to which a left and right-side ground-engaging legs are affixed;

wherein said brackets are configured to be variably positioned and locked along the first mechanical engagement feature so that said legs extend longitudinally at variable distances from the bottom of the ladder so that said legs supports and levels the ladder above ground without the bottom of the ladder contacting the ground, and said legs contacts the ground at a position wider than a width of the ladder to deter lateral tipping;

wherein said apparatus is constructed and arranged to be connected to the ladder in an upward, in-use position of the ladder by laterally receiving the upper portion of said one side rail through said open jaw and then sliding said apparatus downward over the bottom portion of said one side rail.

10. The apparatus recited in claim 9 wherein said crossbar has a telescoping arm at each end and said legs are affixed to the telescoping arms so that said legs may be positioned at different lateral distances relative to said one side rail.

11. The apparatus recited in claim 9 wherein the first and second mechanical engagement features are matching gear racks each having a plurality of teeth extending side-by-side along a length of each mechanical engagement feature.

12. The apparatus recited in claim 9 wherein the crossbar has lateral slots which receive bracket affixation screws.

13. The apparatus recited in claim 9 in combination with said ladder to which it is affixed.

14. The apparatus recited in claim 13 wherein each of the first mechanical engagement features has a gear rack adapted for engagement with a gear rack on one of the second mechanical engagement features.

15. The apparatus recited in claim 13, wherein a width of said open jaw is smaller than the front-to-back effective clamping depth but larger than the width of the front and back faces of the side rail.

16. The apparatus recited in claim 9, wherein said one side rail has an enlarged, front-to-back effective width in the bottom adjacent the first engagement features, which prevents the clamp bracket from being installed on or removed from said one side rail in the bottom portion.

* * * * *